US006934171B2

(12) United States Patent
Dillon et al.

(10) Patent No.: US 6,934,171 B2
(45) Date of Patent: Aug. 23, 2005

(54) SEMICONDUCTOR INTEGRATED CIRCUIT HAVING VOLTAGE-DOWN CIRCUIT REGULATOR AND CHARGE SHARING

(75) Inventors: Michael N. Dillon, Richfield, MN (US); Bret A. Oeltjen, Elko, MN (US)

(73) Assignee: LSI Logic Corporation, Milpitas, CA (US)

( * ) Notice: Subject to any disclaimer, the term of this patent is extended or adjusted under 35 U.S.C. 154(b) by 154 days.

(21) Appl. No.: 10/672,125

(22) Filed: Sep. 26, 2003

(65) Prior Publication Data

US 2005/0068014 A1 Mar. 31, 2005

(51) Int. Cl.[7] ..... H02M 1/00
(52) U.S. Cl. ..... 363/147
(58) Field of Search ..... 323/223, 225, 323/232, 233, 265, 268, 293, 355, 364; 363/147; 327/534, 535, 538, 545

(56) References Cited

U.S. PATENT DOCUMENTS 5,530,612 A * 6/1996 Maloney ..... 361/56
6,353,367 B1 * 3/2002 Chiu ..... 330/311
6,559,701 B1 * 5/2003 Dillon ..... 327/293
6,563,192 B1 5/2003 Corisis et al. ..... 257/532
6,563,343 B1 5/2003 Patel et al. ..... 326/87
6,809,578 B2 * 10/2004 Saitoh ..... 327/541

* cited by examiner

*Primary Examiner*—Matthew V. Nguyen
(74) *Attorney, Agent, or Firm*—Westman, Champlin & Kelly

(57) ABSTRACT

An integrated circuit is provided, which includes first, second and third power supply conductors. The second power supply conductor has a higher voltage than the first power supply conductor, and the third power supply conductor has a higher voltage than the second power supply conductor. A high voltage power supply decoupling capacitor is coupled between the first and third power supply conductors. A low voltage power supply decoupling capacitor coupled between the first and second power supply conductors. A voltage reducer is coupled between the second and third power supply conductors. A plurality of semiconductor devices is biased between the first and second power supply conductors.

17 Claims, 4 Drawing Sheets

SEMICONDUCTOR INTEGRATED CIRCUIT HAVING VOLTAGE-DOWN CIRCUIT REGULATOR AND CHARGE SHARING

FIELD OF THE INVENTION

The present invention relates so semiconductor integrated circuits and, more particularly, to an apparatus and method for reducing power bus transients in an integrated circuit.

BACKGROUND OF THE INVENTION

Integrated circuits are fabricated on a wafer to form a semiconductor die, which is then mounted within a package. The die includes a pattern of semiconductor devices, such as transistors, resistors and diodes, which are fabricated on the wafer. The devices are electrically interconnected with one another through one or more segments of conductive material, which extend along predetermined routing layers. The conductive segments on one routing layer are electrically coupled to conductive segments or devices on other layers through conductive vias. Electrical power is distributed throughout die by a plurality of power supply busses or rails, which are also formed of conductive segments that are routed along the various routing layers.

The package has a plurality of input and output pins for communicating with the semiconductor devices on the die. In addition, the package has one or more power supply pins for supplying power to the power supply rails on the die. During operation, large numbers of transistors on the die switch states on the clock edges. When a transistor changes its output state, the transistor either sinks current from the power supply rails to charge the interconnect capacitance at its output or sources current to the power supply rails to discharge its output capacitance. In essence, the interconnect capacitance at the outputs of the transistors share charge with the external power supply that is coupled to power supply pins of the package.

Due to the large distances between the power supply pins and the individual transistors on the die, the charge sharing between the external power supply and the transistor outputs on the die is relatively insufficient and can generate noise on the transistor outputs and on the voltage levels at the supply rails. A typical method of suppressing this noise and providing a more stable supply voltage is to couple a large internal or external capacitance between the power supply rails. Initially, large capacitors were coupled across the power supply pins of the package. More recently, the capacitance has been moved onto the die by coupling large arrays of parallel transistors between the power supply rails. For example, large arrays of P-channel metal oxide semiconductor (MOS) transistors can be coupled together in parallel with their gates coupled to the positive supply rail and their drains and sources coupled to the negative (ground) supply rail.

However, the amount of capacitance needed to decouple or stabilize the power rails on integrated circuits increases with each new technology generation. As semiconductor devices continue to become smaller, the channel lengths of the transistors decrease, which decreases the maximum voltage that can be applied across the channel. Therefore, the voltage levels that are used to bias the transistors have also decreased. The decrease in channel length in combination with the need to maintain small voltage tolerances makes stabilization of the power supply rails even more critical.

There are several approaches that are being used to address these problems. First, more capacitance is being added between the supply rails on the die per logic function. However this is becoming difficult to achieve with higher circuit densities since unused areas in which the decoupling capacitors can be fabricated are becoming smaller. The capacitance per unit gate or function cannot be increased without blocking usable die area. Second, more logic functions are being performed in an asynchronous manner to reduce the clock-induced change in supply voltage over time. Third, clock skew has been introduced to reduce the number of simultaneously switching events in the logic. While these methods have helped stabilize the power supply voltages, they each have an associated cost and may not be sufficient for future technologies.

Improved on-die power supply structures are desired for further reducing power bus transients.

SUMMARY OF THE INVENTION

One embodiment of the present invention is directed to an integrated circuit, which includes first, second and third power supply conductors. The second power supply conductor has a higher voltage than the first power supply conductor, and the third power supply conductor has a higher voltage than the second power supply conductor. A high voltage power supply decoupling capacitor is coupled between the first and third power supply conductors. A low voltage power supply decoupling capacitor coupled between the first and second power supply conductors. A voltage reducer is coupled between the second and third power supply conductors. A plurality of semiconductor devices is biased between the first and second power supply conductors.

Another embodiment of the present invention is directed to an integrated circuit, which includes a package and a die. The package has first, second and third power supply pins, wherein the second pin has a higher voltage than the first pin and the third pin has a higher voltage than the second pin. The die includes first, second, and third power supply conductors, which are coupled to the first, second and third power supply pins, respectively. A low voltage power supply decoupling capacitor is located on the die and is coupled between the first and second power supply conductors. A plurality of semiconductor devices on the die are biased between the first and second power supply conductors. A high voltage power supply decoupling capacitor is located on the die and is coupled between the first and third power supply conductors. A voltage reducer is coupled between the second and third power supply conductors.

Another embodiment of the present invention is directed to an integrated circuit die, which includes first, second, and third power supply conductors. The second power supply conductor has a higher voltage than the first power supply conductor, and the third power supply conductor has a higher voltage than the second power supply conductor. A low voltage power supply decoupling capacitor is coupled between the first and second power supply conductors. A plurality of semiconductor devices are biased between the first and second power supply conductors. A high voltage power supply decoupling capacitor is coupled between the first and third power supply conductors. A charge coupling circuit is coupled between the second and third power supply conductors for selectively coupling charge from the high voltage power supply decoupling capacitor to the low voltage power supply decoupling capacitor when the voltage between the first and second power supply conductors drops below a reference voltage.

Other features and benefits that characterize embodiments of the present invention will be apparent upon reading the following detailed description and review of the associated drawings.

DETAILED DESCRIPTION OF ILLUSTRATIVE EMBODIMENTS

Figure 1:
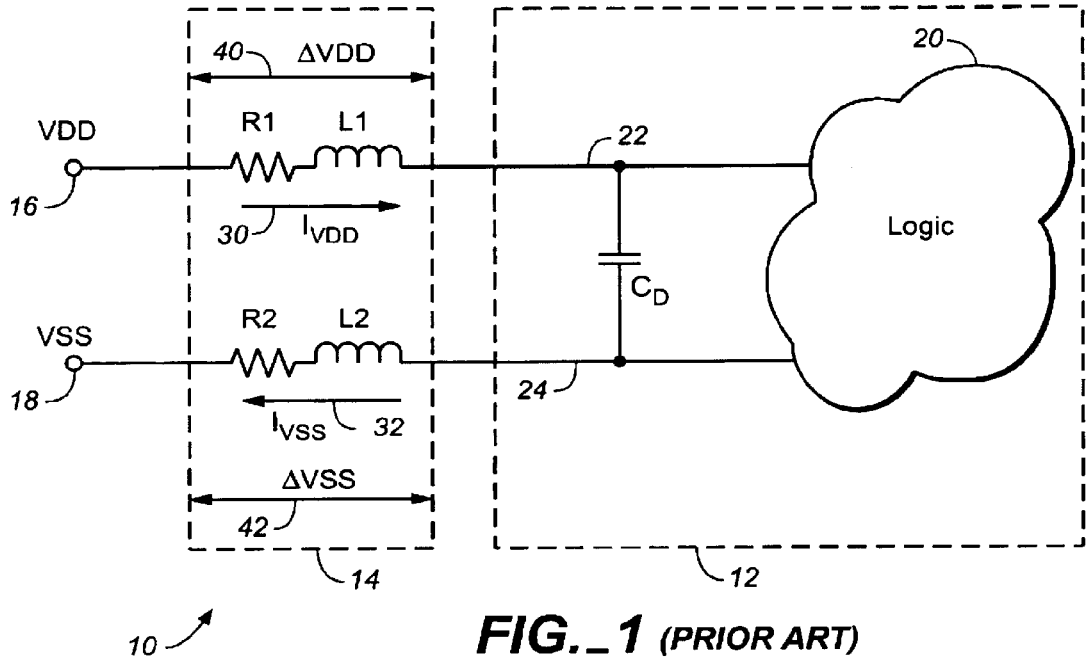
FIG. 1 (PRIOR ART)
FIG. 1 is a schematic diagram of an integrated circuit illustrating a method of reducing power bus transients according to the prior art.

FIG. 1 is a schematic diagram illustrating an integrated circuit 10 having power supply decoupling capacitors according to the prior art. Integrated circuit 10 includes a semiconductor die (represented by dashed line 12), which is mounted in a package (represented by dashed line 14). Package 14 includes a plurality of external pins, including power supply pins 16 and 18. Power supply pins 16 and 18 are coupled to an external DC power supply (not shown) for providing power to internal logic circuit 20 over power supply rails 22 and 24. Pin 16 is biased at a relatively positive voltage level VDD, and pin 18 is biased at a relatively negative voltage level VSS, such as a system ground.

Power supply rails 22 and 24 are electrically coupled to pins 16 and 18 through conductors in package 14. Resistors R1 and R2 and inductors L1 and L2 represent the parasitic resistances and parasitic inductances of the conductors in package 14. Arrows 30 and 32 represent the currents $I_{VDD}$ and $I_{VSS}$ through the parasitic resistances R1 and R2 and inductances L1 and L2 as charged is supplied to and from power supply rails 22 and 24. Arrows 40 and 42 represent the voltage drops ΔVDD and ΔVSS across the package 14 due to the parasitic resistances and inductances.

During operation of integrated circuit 10, a large number of transistors in logic circuit 20 switch states on the clock edges. When a transistor in logic circuit 20 changes its output state, the transistor either sinks current from rail 22 to charge the interconnect capacitance at its output or sources current to rail 24 to discharge the interconnect capacitance. In essence, the interconnect capacitances at the outputs of the transistors share charge with a capacitance in the external power supply (not shown) that is coupled to power supply pins 16 and 18.

This charge sharing can introduce noise at the outputs of the transistors and can cause transients in the voltage level between rails 22 and 24. One method that has been used to stabilize the supply voltage on rails 22 and 24 is to provide a decoupling capacitance $C_D$ between rails 22 and 24. Decoupling capacitance $C_D$ have been formed by coupling large arrays of transistor gate capacitances in parallel with one another between the supply rails. These capacitors assist in sharing charge with the interconnect capacitances of the transistors and logic circuit 20.

With the circuit shown in FIG. 1, the time derivative of $I_{VDD}$ equals the change in voltage ΔVDD divided by the package inductance L1. For a given technology, the maximum ΔVDD that is allowed across package 14 is on the order of 10%. For example, if the desired core supply voltage level between rails 22 and 24 is 5 volts and a 5 volt supply voltage is applied to input pins 16 and 18, the maximum voltage drop that is allowed across package 14 is about 0.5 volts. As core supply voltages continue to reduce with each new technology generation, the maximum voltage drop across the packaging also reduces. For example, with a 1.2 volt supply voltage, the maximum voltage drop ΔVDD across the package is only 0.12 volts.

Since the allowed ΔVDD is dropping and the time derivative of $I_{VDD}$ is increasing with faster technologies, the designer needs to add more or better package pins to reduce the effective series inductances L1 and L2 and/or continue to add more decoupling capacitance in die 12 in order to compensate. This has been accomplished by using advanced packaging, such as flip-chip packaging, and by devoting more area on die 12 to the decoupling capacitors $C_D$. However, flip-chip packages are expensive and the available area fabricating the decoupling capacitors is decreasing. Therefore, active areas on die 12 that could normally be used for functional logic must be blocked to reserve space for the decoupling capacitors.

Figure 2:
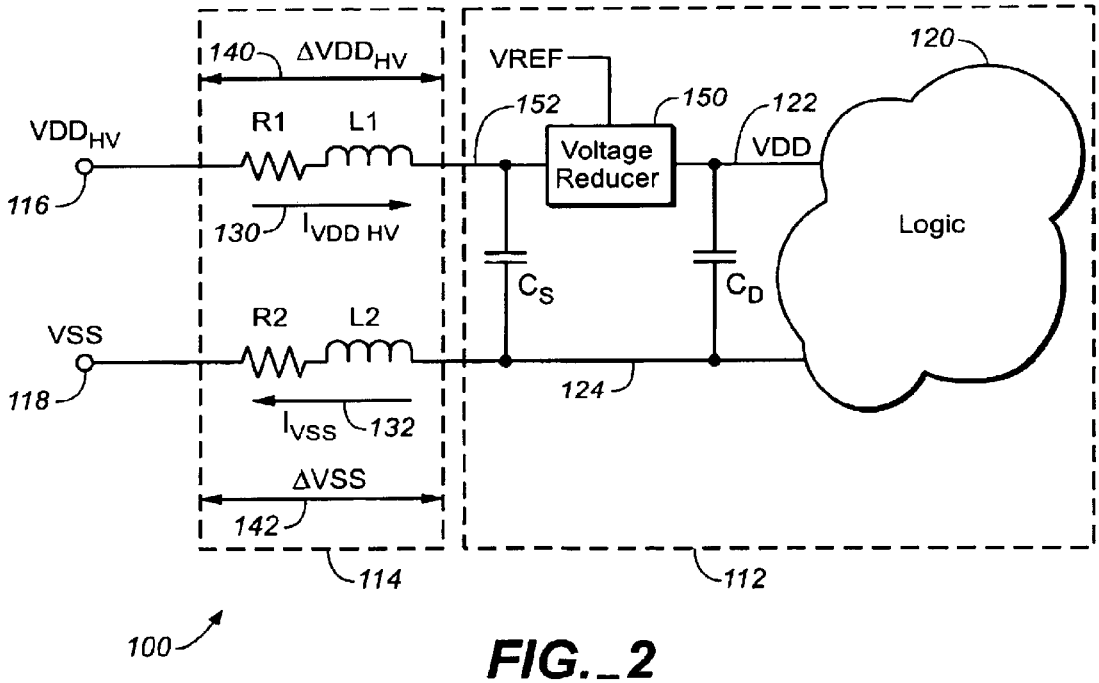
FIG. 2 is a schematic diagram of an integrated circuit illustrating a method for reducing power bus transients according to one embodiment of the present invention.

FIG. 2 is a schematic diagram illustrating an integrated circuit 100 according to one embodiment of the present invention. Integrated circuit 100 includes a semiconductor die 112, which is mounted in a package 114. Die 112 has a core with logic 120. Logic 120 includes one or more semiconductor devices that are fabricated on die 112 for performing a desired function. These semiconductor devices are biased between voltage supply rails 122 and 124. Supply rail 122 has a voltage VDD relative to supply rail 124. In one embodiment, VDD is approximately 1.2 volts. However, other bias voltages can also be used in alternative embodiments.

Package 114 includes power supply input pins 116 and 118. Pin 116 is biased at a high voltage $VDD_{HV}$, which is higher than the core supply voltage VDD on die 112. For example, pin 116 can be biased at 5 volts, 3.3 volts or any other suitable voltage level. Pin 118 is biased at a lower voltage VSS, such as a ground level.

Once again, package 114 includes parasitic resistances R1 and R2 and parasitic inductances L1 and L2, which are effectively coupled in series with power and ground supply pins 116 and 118. Arrow 130 represents the current $I_{VDD\text{-}HV}$ that flows through R1 and L1 to supply charge to logic 120 from high voltage pin 116. Similarly, arrow 132 represents the current $I_{VSS}$ that flows through R1 and L2 while sinking charge from logic 120. Arrow 140 represents the voltage drop $\Delta VDD_{HV}$, across the parasitic resistance R1 and parasitic inductor L1 of package 114. Arrow 142 represents the voltage drop ΔVSS across the parasitic resistance R2 and parasitic inductor L2 of package 114.

Voltage reducer 150 is coupled between voltage supply rail 122 and voltage supply rail 152. Voltage supply rail 152 has a relatively high voltage $VDD_{HV}-\Delta VDD_{HV}$. Voltage reducer 150 reduces the voltage level from $VDD_{HV}-\Delta VDD_{HV}$ to the lower, core supply voltage level VDD on voltage supply rail 122. One or more high voltage decoupling capacitors $C_S$ are coupled between high voltage supply rail 152 and ground supply rail 124 for storing charge that can be shared with decoupling capacitor $C_D$ and the interconnect capacitance within logic 120.

Voltage reducer 150 can include any suitable type of voltage reducer, such as an active switching type of voltage regulator. For example, voltage reducer 150 can include a transistor connected in series between rails 152 and 122 and having a gate coupled to voltage reference input VREF. With such a switching-type voltage regulator, when the voltage on supply rail 122 drops a gate-source threshold voltage below VREF the regulator switches states and passes charge from high voltage supply rail 152 and high voltage decoupling capacitor $C_D$ to low voltage supply rail 122 and decoupling capacitor $C_D$ in order to restore the supply voltage that is delivered to logic 120. When the voltage on supply rail 122 increases to within a gate-source threshold voltage of VREF, the regulator switches off, and decouples rails 122 and 152. High voltage decoupling capacitor $C_S$ provides a ready supply of charge through voltage reducer 150. This reduces the amount of active area on die 112 that has to be dedicated to power supply decoupling capacitors $C_D$. Other high-efficiency types of voltage regulators can also be used. Also, more than one on-chip regulator 150 can be used on integrated circuit 100. The use of multiple regulators could reduce the amount of metal that needs to be dedicated to global power busing.

High voltage decoupling capacitor $C_S$ can include any suitable type of capacitor that can be fabricated on semiconductor die 112. For example in one embodiment, capacitor $C_S$ is fabricated as a parallel-plate, metal-insulator-metal ("MIM") capacitor, wherein metal on two different metal layers in die 112 form parallel capacitor plates that overlap one another and are separated by a dielectric insulating layer. Each plate is electrically coupled to a respective one of the power and ground supply rails 122 and 124. In one embodiment, the dielectric layer separating the plates of capacitor $C_S$ is formed of a different material having a higher dielectric constant than corresponding insulator layers within the core region of die 112 in which logic 120 is fabricated. This provides decoupling capacitor $C_S$ with higher breakdown voltage and therefore a higher capacitance per unit area. However, the same type of dielectric can also be used. Also, the metal plates that form the capacitor can be formed using the same type of metal that is used in the core region of die 112 or with a different type of metal. Other types of capacitors can also be used, such as interlaced metal type capacitors.

Decoupling capacitors $C_D$ can be performed by large arrays of transistors connected together in parallel to form gate-type capacitors. For example with N-Channel (or P-Channel) MOS transistors, each of these transistors can have a gate coupled to voltage supply rail 122 and a source and drain coupled to voltage supply rail 124. In an alternative embodiment, capacitors $C_D$ are also formed as parallel-plate capacitors in unused or reserved areas of die 112. Metal in one metal layer can be coupled to supply rail 122 and overlapping metal in another metal layer can be coupled to supply rail 124. The two capacitor plates are separated by an insulating layer having either a low or high dielectric constant.

In the embodiment shown in FIG. 2, a higher voltage (e.g., $VDD_{HV}$) is supplied to power supply pin 116 than is needed to bias logic 120, and voltage reducer 150 reduces the input voltage to a suitable low bias voltage VDD. Increasing the voltage applied to pin 116 relative to VDD increases the allowed voltage drop across package 114 while still providing an appropriate low voltage level through reducer 150. For example, if the input supply voltage were 3.3 volts, and the desired core voltage VDD for die 112 is 1.2 volts, the allowed $\Delta VDD_{HV}$ would be increased from 0.12 volts (in the embodiment shown in FIG. 1) to over 2 volts (in the embodiment shown in FIG. 2).

By increasing the allowed voltage drops $\Delta VDD_{HV}$ and $\Delta VSS$, higher time derivatives of $I_{VDD}$ and $I_{VSS}$ can be achieved. The use of a power supply voltage increases the dynamic response of the power supply through the parasitic elements of the package since the rate of current change to the integrated circuit is directly proportional to the allowed voltage drop. Also, high voltage decoupling capacitor $C_S$ eliminates most all effects of the parasitic elements of the package since it provides a steady supply of charge, thereby allowing for a much faster response to voltage transients on rails 122 and 124.

Figure 3:
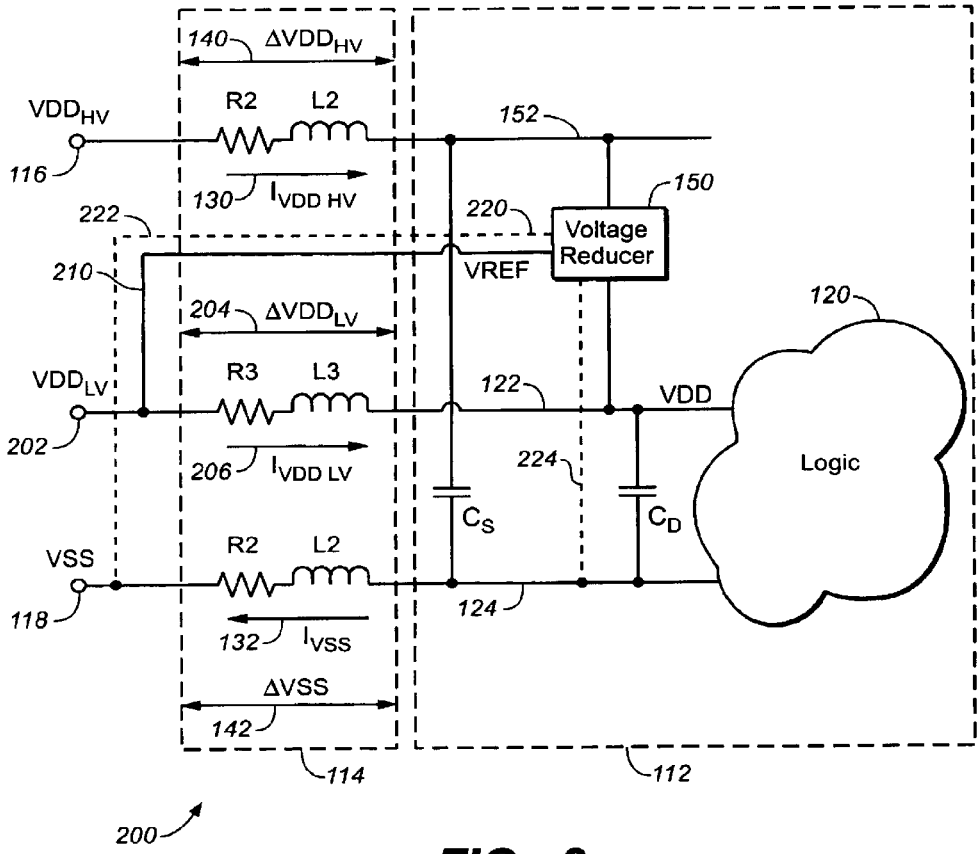
FIG. 3 is a schematic diagram of an integrated circuit illustrating a method for reducing power bus transients according to an alternative embodiment of the present invention.

FIG. 3 is a schematic diagram illustrating an integrated circuit 200 according an alternative embodiment of the present invention. The same reference numerals that are used in FIG. 3 as were used in FIG. 2 for the same or similar elements. In integrated circuit 200, package 114 further includes a low voltage power supply input pin 202, which is coupled to low voltage power supply rail 122 on die 112 through a package lead having a parasitic resistance R3 and parasitic inductance L3. Pin 202 is biased at a low supply voltage $VDD_{LV}$. Arrow 204 represents the voltage drop $\Delta VDD_{LV}$ across the parasitic resistance R3 and the parasitic inductance L3 for pin 202, and arrow 206 represents the current $I_{VDD\ LV}$ through R3 and L3. Pins 118 and 202 and decoupling capacitors $C_D$ supply the primary, steady state charge between supply rails 122 and 124 for operating logic 120.

Voltage reducer 150 provides a fast, dynamic response for sharing dynamic charge between $C_S$ and $C_D$ as needed to maintain low voltage supply rail 122 within a desired range. This reduces the thermal power that would need to be dissipated through reducer 150 as compared to the voltage regulation scheme shown in FIG. 2 and augments the response of decoupling capacitors $C_D$. In this embodiment, the voltage reference input VREF is electrically coupled to pin 202 through a separate package lead 210 for providing a reference voltage for reducer 150. The parasitic resistance and inductance are not shown for lead 210 since VREF is a low current input to reducer 150.

Low voltage power supply pin 202 has a higher voltage ($VDD_{LV}$) than pin 118 (VSS) and a lower voltage than pin 116 ($VDD_{HV}$). For example, pin 118 can be biased at a system ground level, pin 202 can be biased at the core voltage supply level for die 112, such as 1.2 volts (or any other core voltage level), and pin 116 is biased at a higher voltage level, such as 3.3 volts, 5 volts or any other suitable level.

In an alternative embodiment, voltage reducer 150 further has a ground voltage reference input 220, which is coupled to ground power supply pin 118 through a package lead 222, as shown in phantom, for providing a ground reference voltage for reducer 150. Reducer 150 has a corresponding input 224, which is coupled to ground supply rail 124 such that the voltage reducer can also compare differences in the ground voltages.

In the embodiments discussed above, some of the voltage regulation is transferred from the off-chip external voltage supply to an on-chip device. This allows the voltage that is supplied to the integrated circuit to be raised to allow a greater voltage drop across the package leads while still allowing the voltages on the power supply rails to remain within specification. Also, a high voltage capacitor can then be used to supply dynamic charge to the internal supply rails as needed to maintain a relatively constant core supply voltage.

Figure 4:
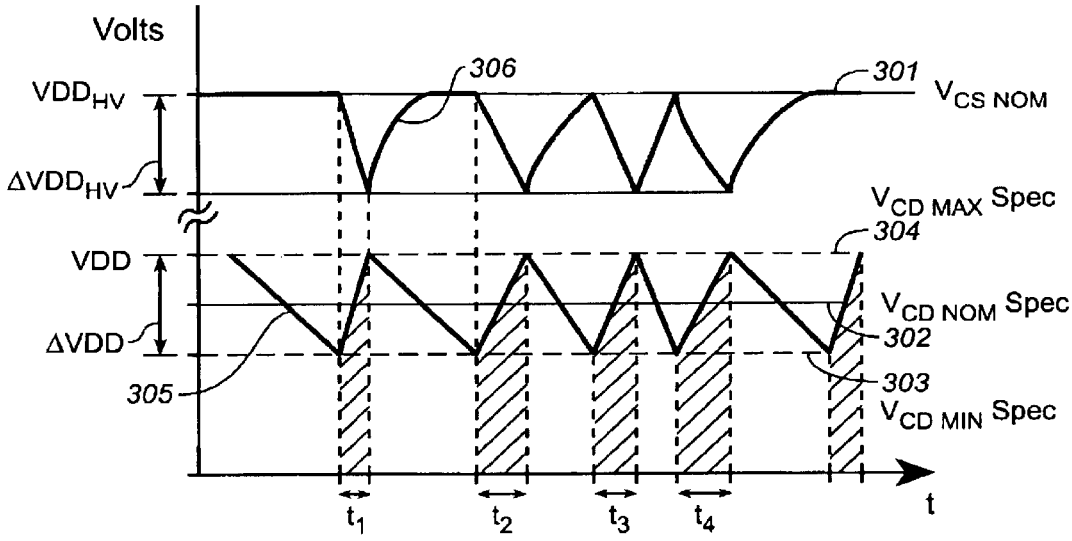
FIG. 4 is a waveform diagram illustrating the operation of a voltage regulator in the embodiment shown in FIG. 2.
Figure 5:
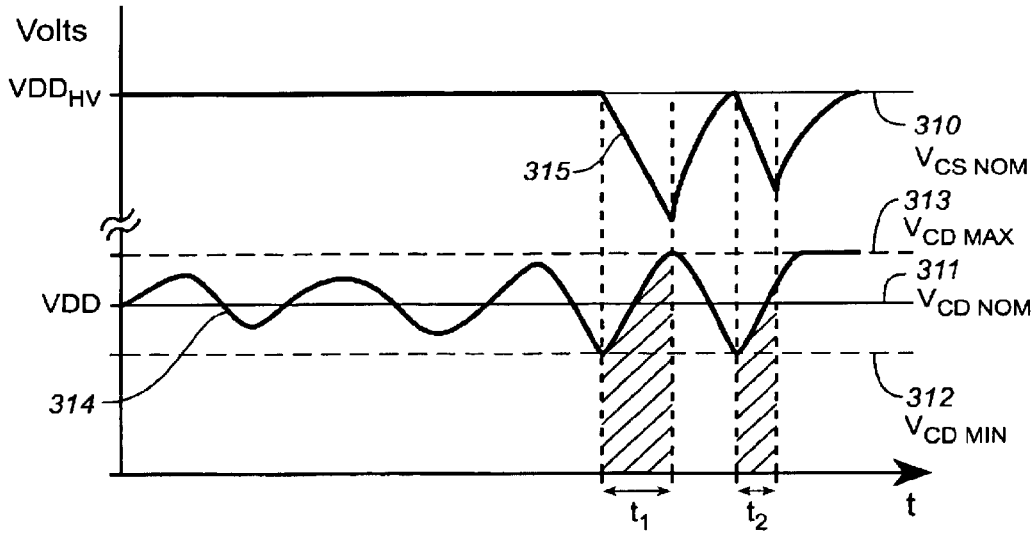
FIG. 5 is a waveform diagram illustrating the operation of a voltage regulator in the embodiment shown in FIG. 3.

FIGS. 4 and 5 are waveform diagrams illustrating the difference in operation between the embodiments shown in FIGS. 2 and 3. FIG. 4 illustrates the operation and effect of the voltage regulator in the embodiment shown in FIG. 2. Line 301 represents the nominal voltage $V_{CS\ NOM}$ across high voltage capacitor $C_S$, which is substantially equal to $VDD_{HV}$. Line 302 represents the nominal voltage $V_{CD\ NOM}$ across low voltage capacitor $C_D$, which is substantially equal to the desired value of VDD. Lines 303 and 304 represent the minimum and maximum specifications $V_{CD\ MIN}$ and $V_{CD\ MAX}$ for the desired voltage VDD across capacitor $C_D$. Line 305 represents the actual voltage VDD across capacitor $C_D$. Line 306 represents the actual voltage across capacitor $C_S$.

As VDD (line 305) drops due to a switching event within the core, it reaches the specified $V_{CD\ MIN}$ at the beginning of time range t1. Voltage reducer 150 switches on and "shorts" $C_S$ to $C_D$, thereby raising VDD back toward $V_{CD\ NOM}$. When VDD reaches $V_{CD\ MAX}$ at the end of time range t1, reducer 150 turns off and VDD drifts back down toward $V_{CD\ NOM}$. This process repeats during time ranges t2, t3 and t4. During each time range t1-t4, regulator 150 "shorts" $C_S$ to $C_D$ to transfer charge from $C_S$ to $C_D$. This causes a corresponding drop in the voltage $V_{CS}$, as shown by line 306. Charge on high voltage capacitor $C_S$ is restored through the external power supply coupled to package 114. With this embodiment, the change in voltage $\Delta VDD_{HV}$ across $C_S$ can be much greater than the change in voltage $\Delta VDD_{LV}$ across $C_D$ allowing a greater voltage drop across the package without negatively impacting the lower core voltage VDD.

FIG. 5 illustrates the operation and effect of the voltage reducer in the embodiment shown in FIG. 3, which limits the operation of the reducer to regulate only the large dynamic events on the low core supply rail. This limits the power consumed by the voltage reducer. Line 310 represents the nominal voltage $V_{CS\ NOM}$ across high voltage capacitor $C_S$, which is substantially equal to $VDD_{HV}$. Line 311 represents the nominal voltage $V_{CD\ NOM}$ across low voltage capacitor $C_D$, which is substantially equal to the desired value of the low core voltage VDD. Lines 312 and 313 represent the minimum and maximum specifications $V_{CD\ MIN}$ and $V_{CD\ MAX}$ for the desired voltage VDD across capacitor $C_D$. Line 314 represents the actual voltage VDD across capacitor $C_D$. Line 315 represents the actual voltage across capacitor $C_S$.

As VDD (line 314) varies due to switching events within the core, the external power supply that is coupled to low voltage pin 202 performs most of charge sharing for maintaining VDD within the minimum and maximum specifications (lines 312 and 313). However with large dynamic events that cause VDD to reach the limits of the specification range, voltage reducer 150 turns on to couple $C_S$ to $C_D$ and restore the charge across low voltage capacitor $C_D$. In the example shown in FIG. 5, voltage reducer 150 turns on during time ranges t1 and t2 only.

Figure 6:
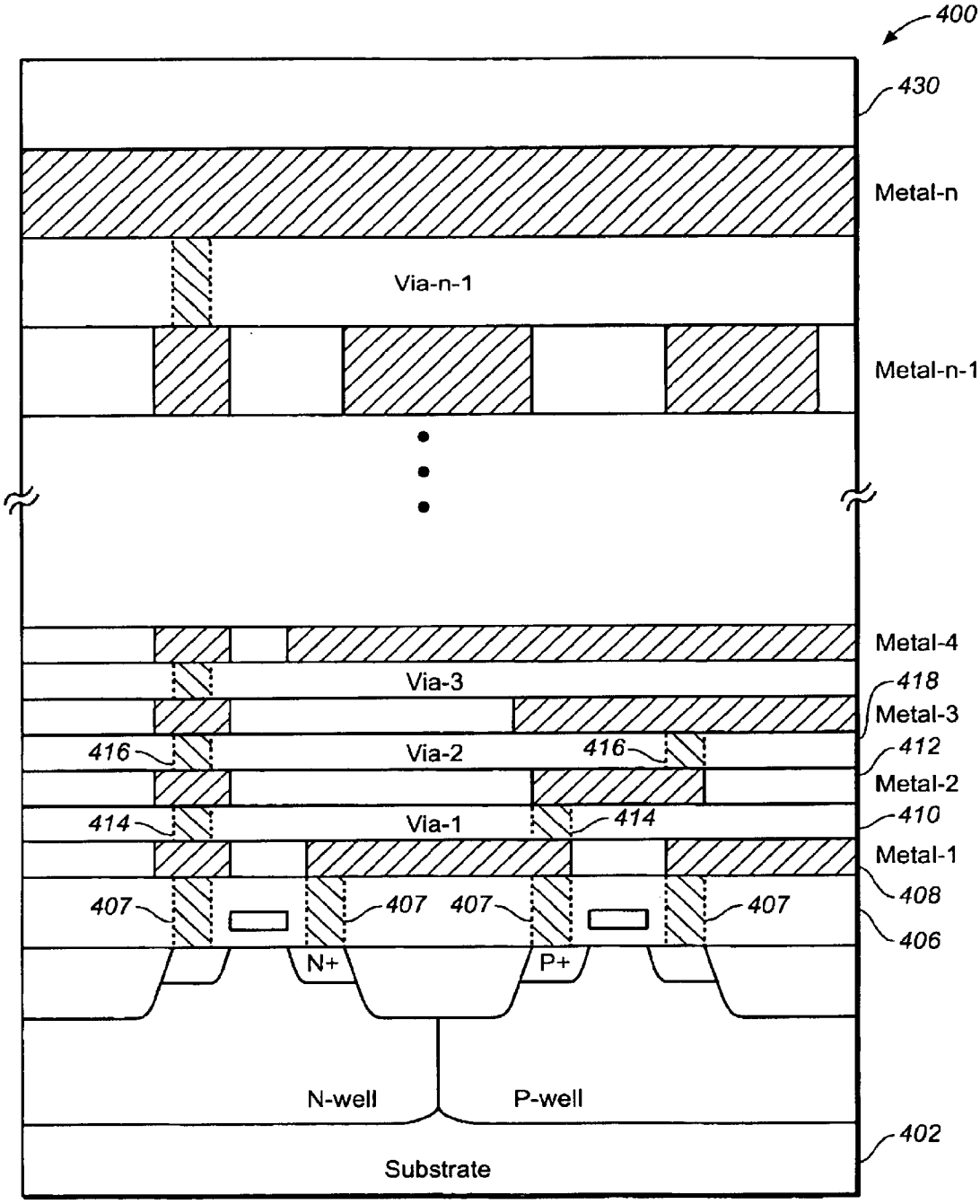
FIG. 6 is a schematic diagram illustrating a partial cross-sectional view of an exemplary ASIC on which the present invention may be implemented.

FIG. 6 is a schematic diagram illustrating a partial cross-sectional view of an exemplary ASIC 400 in which the present invention may be implemented. ASIC 400 may be formed on a semiconductor substrate 402. Those of the ordinary skill in the art will understand that a number of photolithography masks may be used to form semiconductor devices, which are building blocks of logic gates and other circuits. Such masks may be used for forming buried layers and isolation (e.g., well structures), diffusion regions, gate electrodes and the like. FIG. 6 shows two of such semiconductor devices. After the semiconductor devices are formed, a contact layer 406 is formed on top of the semiconductor devices by growth or deposition of insulating materials. Contact holes or "vias" 407 are then formed within contact layer 406 and metal is deposited inside the contact holes. Contact layer 406 is used to provide input and output connections to the semiconductors formed on substrate 402.

After the base layers have been fabricated on substrate 402, a metal layer 408 (Metal-1) is deposited on top of contact layer 406 and then patterned so that metal remains only in desired locations or patterns (known as a "metallization" pattern). Then, an insulation layer 410 (Via-1) is formed on top of Metal-1 layer 408. Vias 414 are formed within Via-1 layer 410, and metal is deposited inside vias 414. Then, a second metal layer 412 (Metal-2) is deposited on top of Via-1 layer 410 and patterned so that metal remains only in desired locations. An insulation layer (Via-2) 418 is formed on top of Metal-2 layer 112. Vias 416 are formed within Via-2 layer 418 and metal is deposited inside the vias 416. This process can be repeated for each metal layer and insulation layer that is required to be formed. As shown, ASIC 400 can include "n" metal layers (Metal-1 to Metal-n), n-1 Vias (Via-1 to Via-n-1), and one contact layer. A surface passivation layer 430 can be formed on top of the metal layer, Metal-n. Any number of layers can be used in alternative embodiments of the present invention.

The metallization pattern in each metal layer forms one or more conductive segments that can be used for interconnecting the semiconductor devices formed on substrate 402, such as in logic 120, voltage reducer 150 and decoupling capacitors $C_D$ shown in FIGS. 2 and 3. Typically, the conductive segments in one metal routing layer are orientated orthogonally to the conductive segments in the next adjacent metal routing layer. The contacts of each semiconductor device on the integrated circuit are connected to the contacts of other semiconductor devices or features on the integrated circuit through one or more conductive "nets". These nets are formed by conductive segments on one or more metal layers, Metal-1 to Metal-n, which are connected through one or more of the vias, such as vias 114 or 116. The location of each conductive segment and via that is formed on the integrated circuit is defined by the photolithography masks used to form the routing layers and the vias. Also, the voltage supply rails 122, 124 and 152 are formed by one or more conductive segments on one or more of the metal layers.

In the embodiment in which high voltage decoupling capacitors $C_S$ are formed as parallel-plate MIM type capacitors, the opposing plates of the capacitors are formed along two or more of the metal layers and are separated by at least one of the insulating layers. Conductive vias or other conductive segments can then be used to couple these plates to the supply rails. Again the same or different material can be used for the metal capacitor plates and the insulating layer between the plates as are used in corresponding layers within the active areas of the integrated circuit.

Although the present invention has been described with reference to preferred embodiments, workers skilled in the art will recognize that changes may be made in form and detail without departing from the spirit and scope of the invention. The term "coupled" as used in the specification and in the claims can include a direct connection or a connection through one or more additional components.

What is claimed is:

1. An integrated circuit comprising:

first, second and third power supply conductors, wherein the second power supply conductor has a higher voltage than the first power supply conductor and the third power supply conductor has a higher voltage than the second power supply conductor;

a high voltage power supply decoupling capacitor coupled between the first and third power supply conductors;

a low voltage power supply decoupling capacitor coupled between the first and second power supply conductors;

a voltage reducer coupled between the second and third power supply conductors; and a core circuit portion formed of a plurality of semiconductor devices, which are biased between the first and second power supply conductors.

2. The integrated circuit of claim 1 and further comprising:

a die comprising the first, second and third power supply conductors, the high and low power supply decoupling capacitors, the voltage reducer and the core circuit portion; and a package comprising a high voltage power supply pin electrically coupled to the third power supply conductor, and a ground power supply pin electrically coupled to the first power supply conductor.

3. The integrated circuit of claim 2 wherein the package further comprises:

a low voltage power supply pin electrically coupled to the second power supply conductor, which has a voltage that is higher than the ground power supply pin and lower than the high voltage power supply pin.

4. The integrated circuit of claim 3 wherein the voltage reducer comprises a reference voltage input, which is coupled to the low voltage power supply pin.

5. The integrated circuit of claim 1 wherein the voltage reducer comprises a switching type of voltage regulator, which selectively couples charge from the high voltage power supply decoupling capacitor to the low voltage power supply decoupling capacitor when the voltage between the first and second power supply conductors drops below a reference voltage.

6. The integrated circuit of claim 1 wherein the high voltage power supply decoupling capacitor has a higher breakdown voltage than the low voltage power supply decoupling capacitor.

7. The integrated circuit of claim 1 wherein the high voltage power supply decoupling capacitor comprises a parallel-plate, metal-insulator-metal (MIM) capacitor.

8. The integrated circuit of claim 7 wherein the high voltage power supply decoupling capacitor comprises at least one insulator layer that has a higher dielectric constant than corresponding insulator layers in the core circuit portion.

9. The integrated circuit of claim 1 wherein the low voltage power supply decoupling capacitor comprises a plurality of parallel-connected metal oxide semiconductor gate capacitances.

10. An integrated circuit comprising:

a package comprising first, second and third power supply pins, wherein the second pin has a higher voltage than the first pin and the third pin has a higher voltage than the second pin;

a die comprising first, second, and third power supply conductors, which are coupled to the first, second and third power supply pins, respectively;

a low voltage power supply decoupling capacitor on the die and coupled between the first and second power supply conductors;

a plurality of semiconductor devices on the die, which are biased between the first and second power supply conductors;

a high voltage power supply decoupling capacitor on the die and coupled between the first and third power supply conductors; and a voltage reducer on the die and coupled between the second and third power supply conductors.

11. The integrated circuit of claim 10 wherein the voltage reducer comprises a reference voltage input, which is coupled to the second power supply pin.

12. The integrated circuit of claim 10 wherein the voltage regulator comprises a switching type of voltage regulator, which selectively couples charge from the high voltage power supply decoupling capacitor to the low voltage power supply decoupling capacitor when the voltage between the first and second power supply conductors drops below a reference voltage.

13. The integrated circuit of claim 10 wherein the high voltage power supply decoupling capacitor has a higher breakdown voltage than the low voltage power supply decoupling capacitor.

14. The integrated circuit of claim 10 wherein the high voltage power supply decoupling capacitor comprises a parallel-plate, metal-insulator-metal (MIM) capacitor.

15. The integrated circuit of claim 14 wherein the high voltage power supply decoupling capacitor comprises at least one insulator layer that has a higher dielectric constant than corresponding insulator layers fabricated within a core region of the die.

16. The integrated circuit of claim 10 wherein the low voltage power supply decoupling capacitor comprises a plurality of parallel-connected metal oxide semiconductor gate capacitances.

17. An integrated circuit die comprising:

first, second, and third power supply conductors, wherein the second power supply conductor has a higher voltage than the first power supply conductor and the third power supply conductor has a higher voltage than the second power supply conductor;

a low voltage power supply decoupling capacitor coupled between the first and second power supply conductors;

a plurality of semiconductor devices, which are biased between the first and second power supply conductors;

a high voltage power supply decoupling capacitor coupled between the first and third power supply conductors; and charge coupling means coupled between the second and third power supply conductors for selectively coupling charge from the high voltage power supply decoupling capacitor to the low voltage power supply decoupling capacitor when the voltage between the first and second power supply conductors drops below a reference voltage.

* * * * *